US006737112B1

(12) United States Patent
Chang

(10) Patent No.: US 6,737,112 B1
(45) Date of Patent: May 18, 2004

(54) METHOD FOR MAKING A TABLE TOP

(76) Inventor: Yuan-Feng Chang, No. 34, Chung-Cheng Rd., Chu-Chi Tsun, Chu-Chi Hsiang, Chia-I Hsien (TW)

( * ) Notice: Subject to any disclaimer, the term of this patent is extended or adjusted under 35 U.S.C. 154(b) by 0 days.

(21) Appl. No.: 10/376,053

(22) Filed: Feb. 26, 2003

(51) Int. Cl.[7] ..... B05D 1/02; B05D 1/32; B05D 1/36

(52) U.S. Cl. ..... 427/264; 427/272; 427/282; 427/427.4; 427/427.6

(58) Field of Search ..... 427/261, 264, 427/272, 282, 427.4, 427.6; 428/430, 435, 480, 481, 483, 507, 515, 540

(56) References Cited

U.S. PATENT DOCUMENTS 4,199,358 A * 4/1980 Parsons ..... 430/308
4,702,786 A * 10/1987 Tallman ..... 156/154
5,280,052 A * 1/1994 Questel et al. ..... 523/219

* cited by examiner

*Primary Examiner*—Fred J. Parker
(74) *Attorney, Agent, or Firm*—Christensen O'Connor Johnson Kindness PLLC

(57) ABSTRACT

A method for making a table top includes the steps of forming a water-proof layer on a wooden panel, forming an inner stone layer on the water-proof layer, forming an outer stone layer on the inner stone layer, and covering the outer stone layer with a mask that is formed with an access hole, and sand blasting the outer stone layer through the access hole so as to form a through-hole in the outer stone layer which exposes a portion of the inner stone layer.

6 Claims, 8 Drawing Sheets

METHOD FOR MAKING A TABLE TOP

BACKGROUND OF THE INVENTION

1. Field of the Invention

This invention relates to a method for making a table top that includes an inner stone layer and an outer stone layer formed on the inner layer and formed with holes which expose portions of the inner stone layer.

2. Description of the Related Art

Stone tables are attractive by virtue of their texture, are very durable, and are impermeable to water. However, it is relatively difficult and expensive to form patterns and different colors on the surface of the stone table.

SUMMARY OF THE INVENTION

Therefore, the object of the present invention is to provide a method for making a table top that can overcome the aforementioned drawbacks of the prior art.

According to the present invention, there is provided a method for making a table top. The method comprises: forming a water-proof layer on a wooden panel; preparing a first blend of first particulate stone and a first resin; forming an inner stone layer of the first blend on the water-proof layer; preparing a second blend of a second particulate stone and a second resin; forming an outer stone layer of the second blend on the inner stone layer; preparing a mask that is formed with at least an access hole; and covering the-outer stone layer with the mask and subsequently sand blasting the outer stone layer through the access hole in the mask so as to form a through-hole in the outer stone layer that has a shape corresponding to that of the access hole and that exposes a portion of the inner stone layer therefrom.

BRIEF DESCRIPTION OF THE DRAWINGS

In drawings which illustrate an embodiment of the invention.

DETAILED DESCRIPTION OF THE PREFERRED EMBODIMENT

Figure 1:
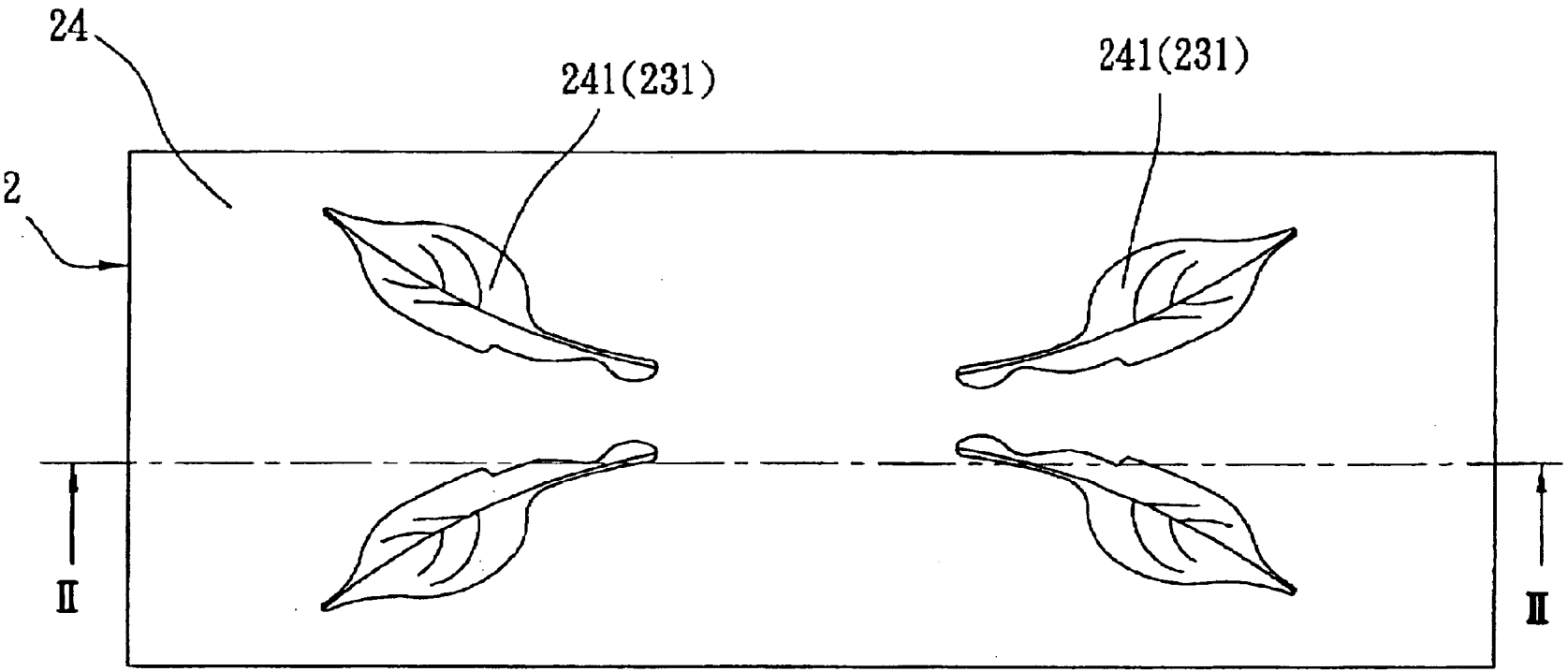
FIG. 1 is a top view of a table top made by a method according to the present invention.
Figure 2:
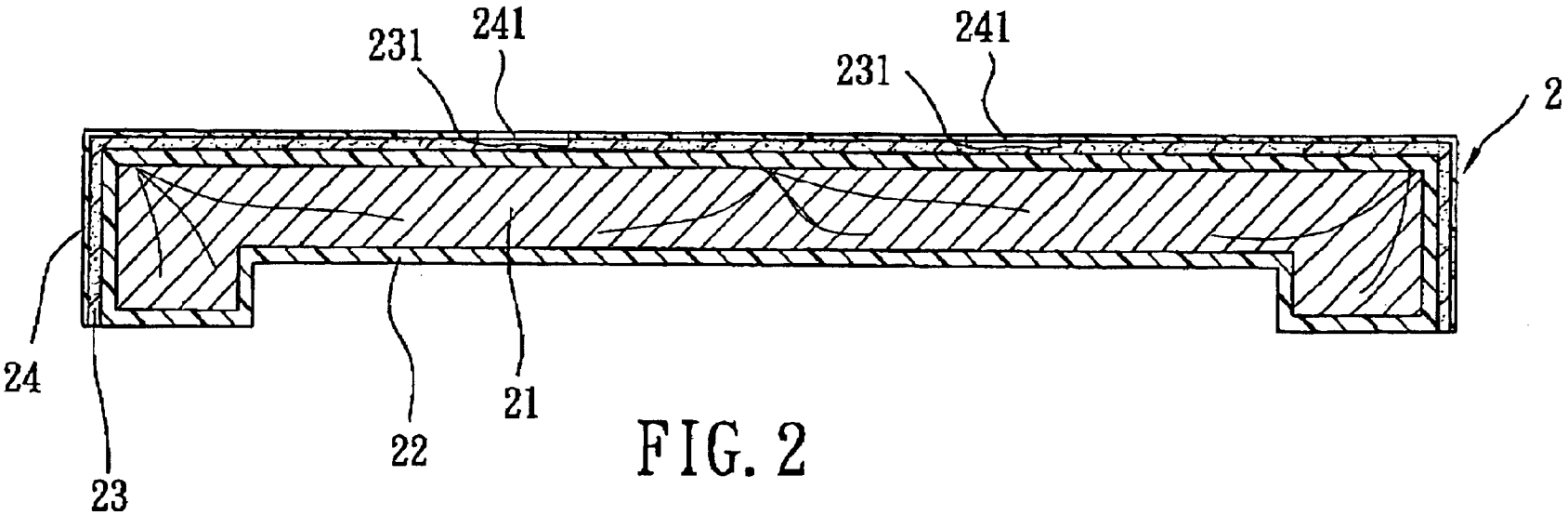
FIG. 2 is a cross-sectional view of the table top taken along line II—II in FIG. 1.
Figure 3:
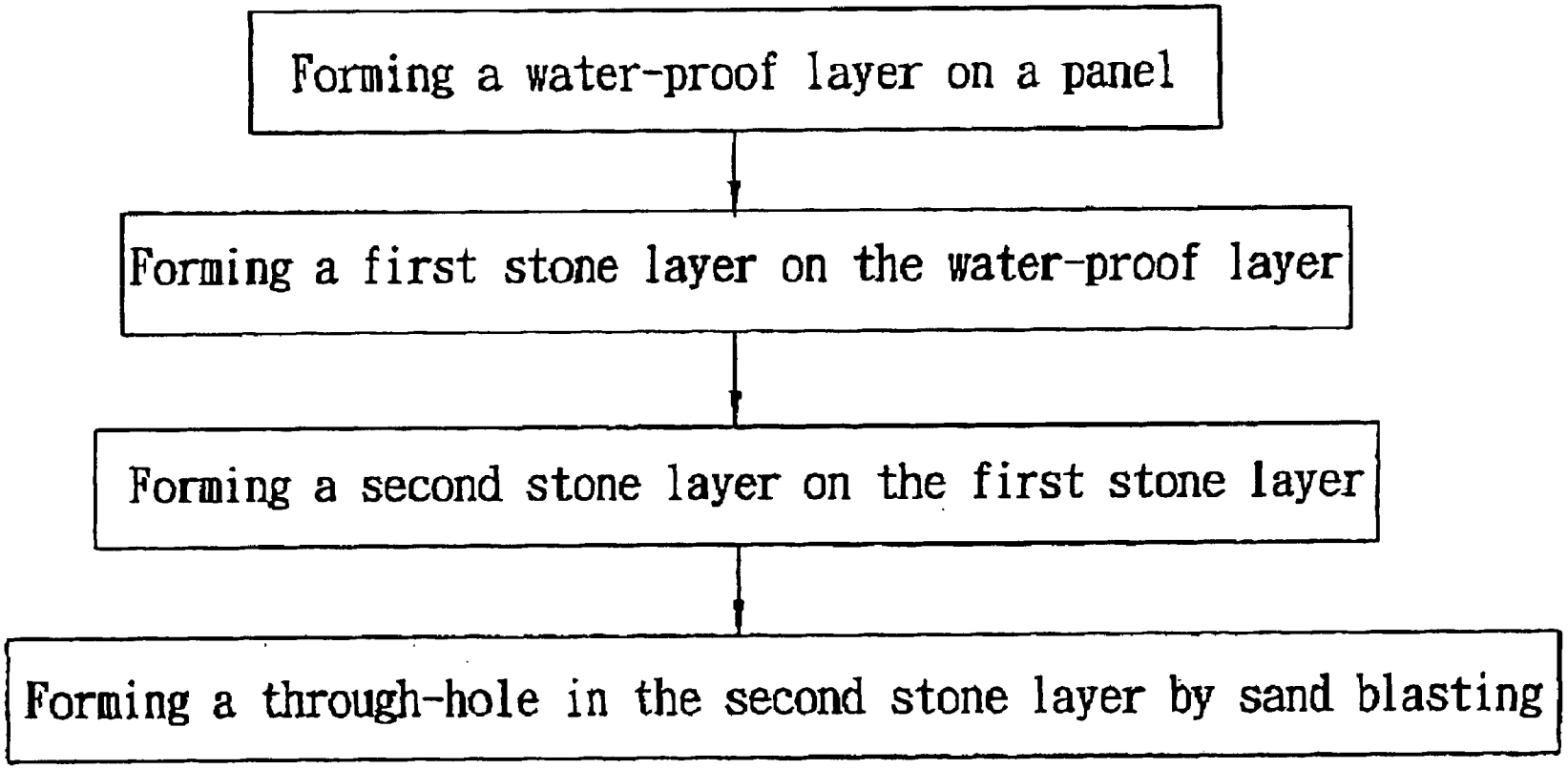
FIG. 3 is a block diagram illustrating consecutive steps of forming the table top of FIG. 1 according to the method of the present invention.
Figure 4:
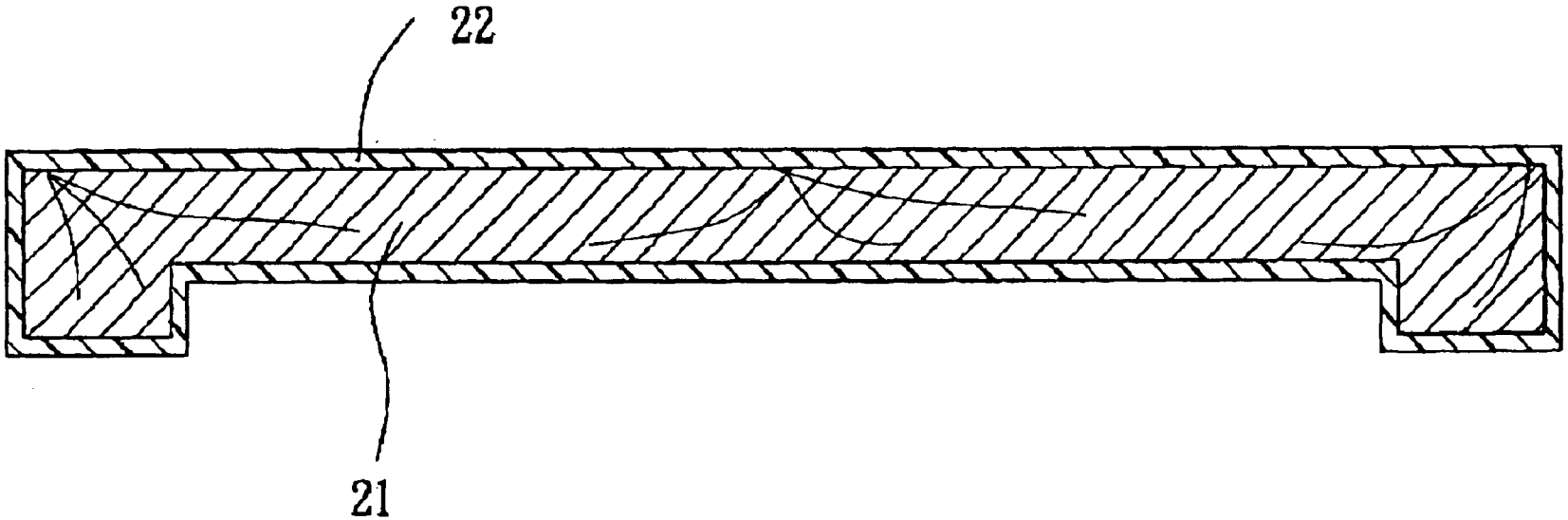
FIG. 4 is a cross-sectional view to illustrate how a water-proof layer is formed on a wooden panel of the table top of FIG. 1 according to the present invention.
Figure 5:
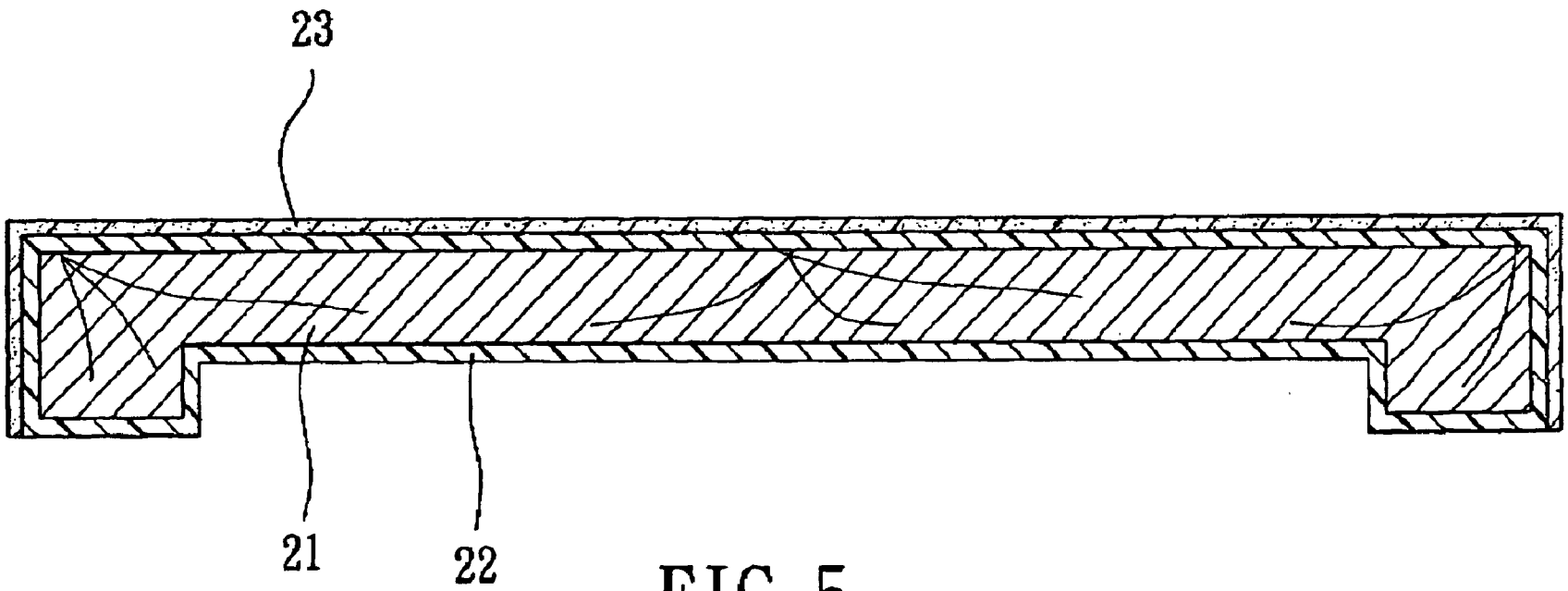
FIG. 5 is a cross-sectional view to illustrate how an inner stone layer is formed on the water-proof layer of FIG. 4.
Figure 6:
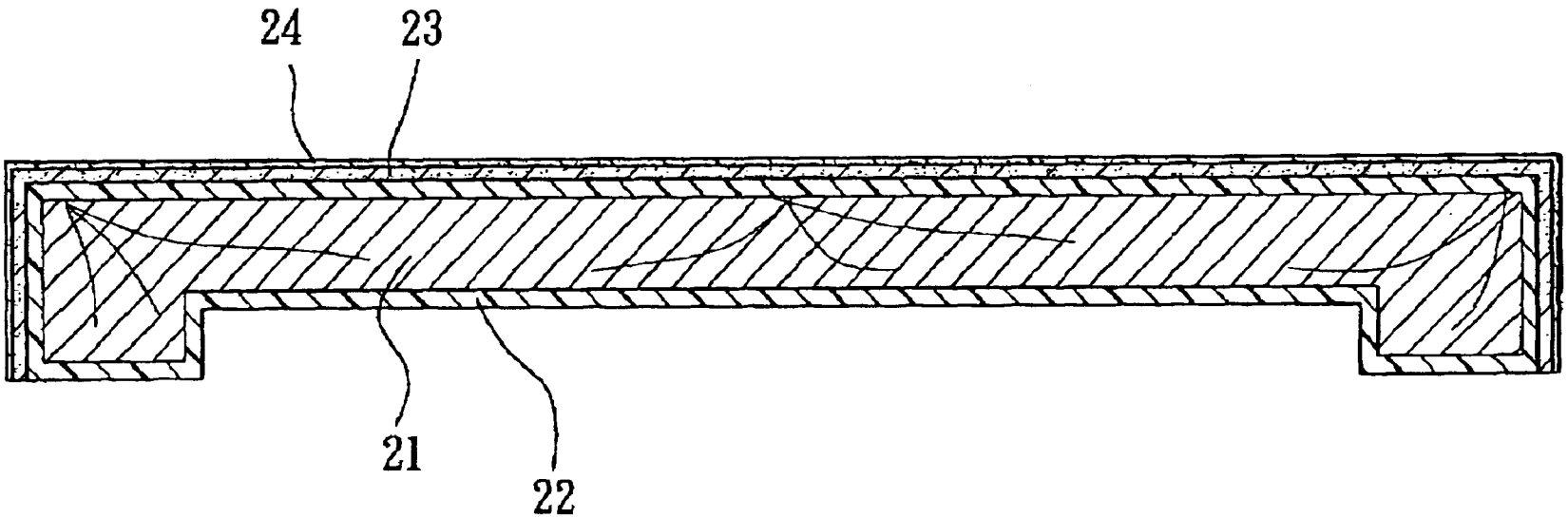
FIG. 6 is a cross-sectional view to illustrate how an outer stone layer is formed on the inner stone layer of FIG. 5.
Figure 7:
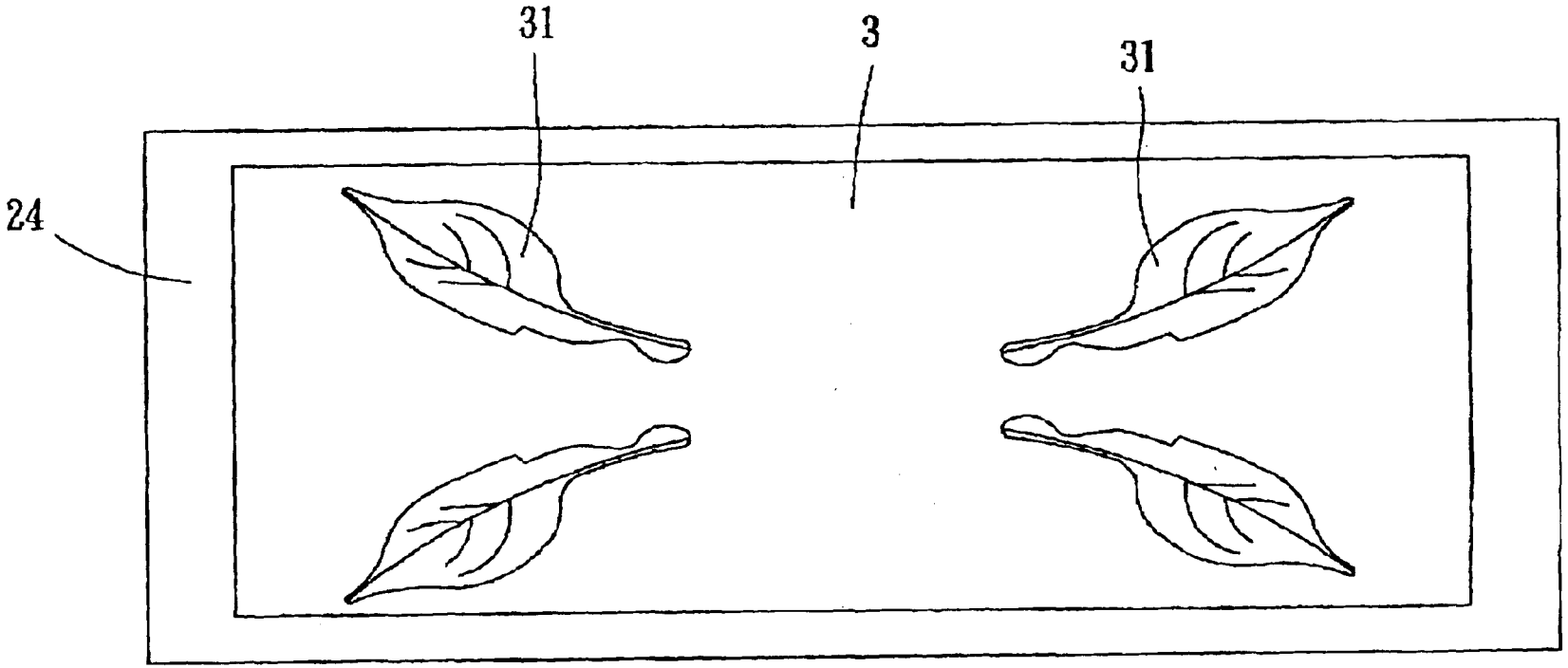
FIG. 7 is a top view to illustrate how a pattern of holes in the outer stone layer is formed by using a mask during sand blasting.

FIGS. 1 and 2 illustrate a table top 2 made by a method (see FIG. 3) according to the present invention. The method includes the steps of: forming a water-proof layer 22 on a wooden panel 21 (see FIG. 4); preparing a first blend of first particulate stone and a first resin; forming an inner stone layer 23 of the first blend on the water-proof layer 22 (see FIG. 5) by spraying techniques; preparing a second blend of a second particulate stone and a second resin; forming an outer stone layer 24 of the second blend on the inner stone layer 23 (see FIG. 6) by spraying techniques; preparing a steel mask 3 that is formed with at least an access hole 31 (see FIG. 7); and covering the outer stone layer 24 with the steel mask 3 (see FIG. 7) and subsequently sand blasting the outer stone layer 24 through the access hole 31 in the mask 3 so as to form a through-hole 241 in the outer stone layer 24 (see FIGS. 1 and 2) that has a shape corresponding to that of the access hole 31 and that exposes a portion 231 of the inner stone layer 23 therefrom. In order to enhance the appearance of the table top 2, the portion 231 of the inner stone layer 23 can be indented to form a recess by sand blasting through the access hole 31 in the steel mask 3 and the through-hole 241 in the outer stone layer 24, and the first and outer stone layers 23, 24 can be made from different stones with different colors.

The wooden panel 21 preferably has a thickness ranging from 10 to 30 mm. The water-proof layer 22 is preferably made from polyester or polyethylene. The inner stone layer 23 preferably has a thickness ranging from 1 mm to 3 mm. The outer stone layer 24 preferably has a thickness less than 1 mm.

The first resin or the second resin is preferably polyester or polyethylene.

Figure 8:
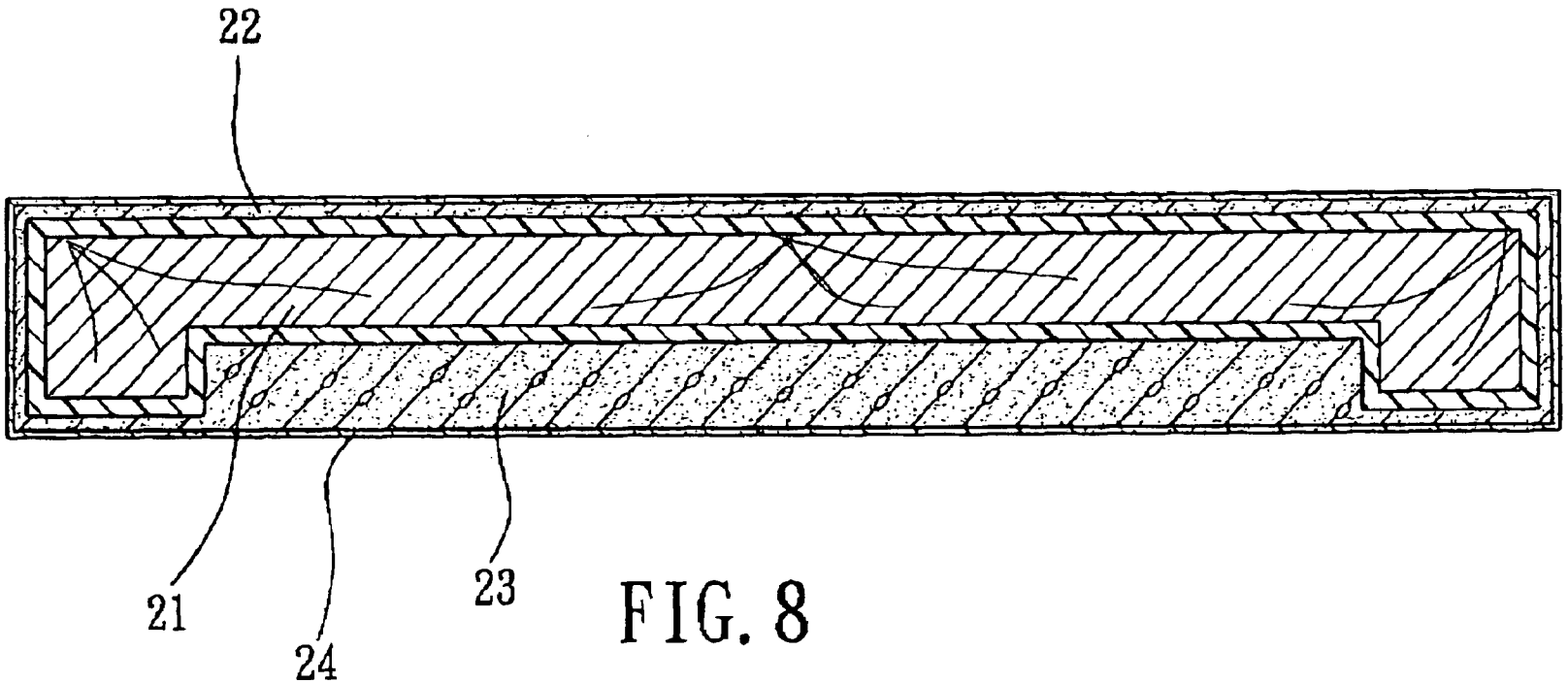
FIG. 8 is a cross-sectional view of a modified table top made by the method of this invention.

FIG. 8 illustrates another table top 2 made by the method of this invention. The table top 2 is similar to that shown in FIG. 1, except that the wooden panel 21 is enclosed by the water-proof layer 22, that the water-proof layer 22 is enclosed by the inner stone layer 23, and that the inner stone layer 23 is enclosed by the outer stone layer 24.

With the method of this invention, formation of patterns and different colors on the top surface of the table top 2 for enhancing of the appearance of the table top 2 can be easily and economically performed.

With the invention thus explained, it is apparent that various modifications and variations can be made without departing from the spirit of the present invention. It is therefore intended that the invention be limited as recited in the appended claims.

I claim:

1. A method for making a table top, comprising the steps of;

forming a water-proof layer on a wooden panel;

preparing a first blend of first particulate stone and a first resin;

forming an inner stone layer of the first blend on the water-proof layer;

preparing a second blend of a second particulate stone and a second resin;

forming an outer stone layer of the second blend on the inner stone layer;

preparing a mask that is formed with at least an access hole; and covering the outer stone layer with the mask and subsequently sand blasting the outer stone layer through the access hole in the mask so as to form a through-hole in the outer stone layer that has a shape corresponding to that of the access hole and that exposes a portion of the inner stone layer therefrom.

2. The method of claim 1, wherein the inner stone layer has a thickness ranging from 1 mm to 3 mm, and the outer stone layer has a thickness less than 1 mm.

3. The method of claim 1, further comprising sand blasting the inner stone layer through the access hole in the mask and the through-hole in the outer stone layer so as to form a recess in the portion of the inner stone layer.

4. The method of claim 1, wherein the wooden panel is enclosed by the water-proof layer.

5. The method of claim 4, wherein the water-proof layer is enclosed by the inner stone layer.

6. The method of claim 5, wherein the inner stone layer is enclosed by the outer stone layer.

* * * * *